US011779108B1

(12) United States Patent
Mirth et al.

(10) Patent No.: US 11,779,108 B1
(45) Date of Patent: Oct. 10, 2023

(54) TABLE WITH SLOTS AND LEDGES

(71) Applicant: Artifox, LLC, St. Louis, MO (US)

(72) Inventors: Sarah Elizabeth-Carpenter Mirth, St. Louis, MO (US); Daniel Joseph Mirth, St. Louis, MO (US); Sean Kirkland, Chesterfield, MO (US)

(73) Assignee: Artifox, LLC, St. Louis, MO (US)

( * ) Notice: Subject to any disclaimer, the term of this patent is extended or adjusted under 35 U.S.C. 154(b) by 77 days.

(21) Appl. No.: 17/510,831

(22) Filed: Oct. 26, 2021

Related U.S. Application Data

(60) Provisional application No. 63/108,839, filed on Nov. 2, 2020.

(51) Int. Cl.
*A47B 21/06* (2006.01)

(52) U.S. Cl.
CPC ..... *A47B 21/06* (2013.01); *A47B 2200/0082* (2013.01)

(58) Field of Classification Search
CPC ..... A47B 21/06; A47B 2200/0082; A47B 2200/008; A47B 2021/064
USPC ..... 108/50.02; 312/223.6
See application file for complete search history.

(56) References Cited

U.S. PATENT DOCUMENTS 4,948,205 A 8/1990 Kelley
5,237,935 A * 8/1993 Newhouse ..... A47B 83/001 108/50.02
5,651,594 A 7/1997 Lechman
6,022,087 A 2/2000 Gilbert
6,202,567 B1 * 3/2001 Funk ..... A47B 21/06 108/50.01
6,216,606 B1 * 4/2001 Kathardekar ..... A47B 21/06 108/50.02
6,283,043 B1 * 9/2001 Stern ..... A47B 21/00 108/50.02
9,095,209 B2 * 8/2015 Mirth ..... A47B 13/16
9,124,308 B2 9/2015 Metcalf
9,516,945 B2 12/2016 Johnson et al.
10,028,576 B1 * 7/2018 Yao ..... A47B 9/20
10,492,601 B2 12/2019 Mirth et al.
11,337,516 B1 * 5/2022 You ..... A47B 9/16
2005/0263041 A1 * 12/2005 Mueller ..... A47B 21/06 108/50.02
2005/0279257 A1 * 12/2005 Betti ..... A47B 21/06 108/50.02

(Continued)

OTHER PUBLICATIONS

SlatePro TechDesk [online], iSkelter. Retrieved from the Internet on Jul. 18, 2017 <URL:http://iskelter.com/product/slatepro-tech-desk/>.

(Continued)

*Primary Examiner* — Jose V Chen
(74) *Attorney, Agent, or Firm* — CREATIVENTURE LAW, LLC; Dennis J M Donahue, III; Kevin Staed

(57) ABSTRACT

A table with a top surface, a bottom surface, a plurality of legs, and at least one slot with a ledge capable of supporting a tab for plugging the slot or an accessory. When engaged in the slot, the tab is flush with the top surface of the table to create a flat work space across the entire area of the tablet. Further, a narrow portion in the slot prevents the tab from falling through while a widened section is provided so that an end of the tab may be pushed downward into the widened section to rotate the opposite end out of the slot to remove the tab.

20 Claims, 6 Drawing Sheets

(56) References Cited

U.S. PATENT DOCUMENTS

| | | | | |
|---|---|---|---|---|
| 2016/0213145 | A1* | 7/2016 | Johnson | A47B 83/001 |
| 2017/0065076 | A1* | 3/2017 | Johnson | A47B 87/002 |
| 2018/0020828 | A1* | 1/2018 | Nourse | A47B 83/001 312/223.6 |
| 2018/0055216 | A1* | 3/2018 | Mirth | A47B 21/04 |
| 2019/0029415 | A1* | 1/2019 | Yoo | A47B 21/06 |
| 2020/0275772 | A1* | 9/2020 | Goldberg | A47B 3/0815 |
| 2021/0204690 | A1* | 7/2021 | Lim | A47B 13/02 |
| 2021/0212452 | A1* | 7/2021 | Colin | A47B 21/06 |

OTHER PUBLICATIONS

Artifox desk [online], Artifox Retrieved from the Internet on Jul. 18, 2017 <https://web.archive.org/web/20140506011538/http://www.theartifox.com/#intro>.

U.S. Appl. No. 17/239,955, Title: Table With Cable Passageways, Applicant/Inventor: White, filed Apr. 26, 2021.

* cited by examiner

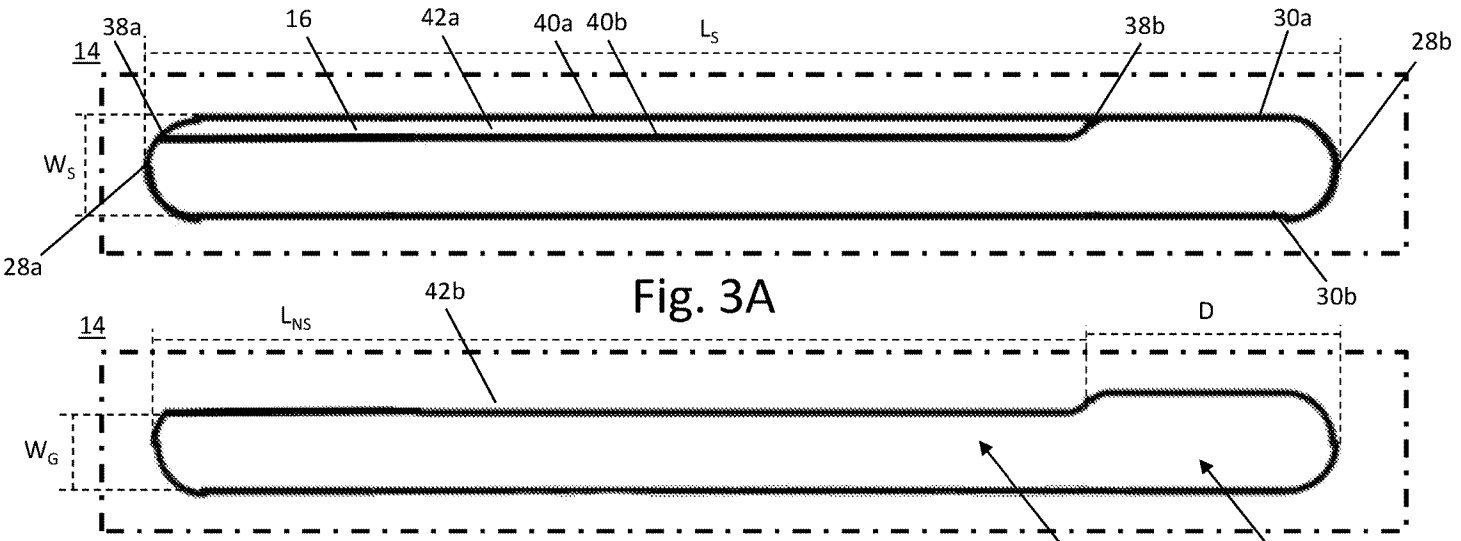
Fig. 3A
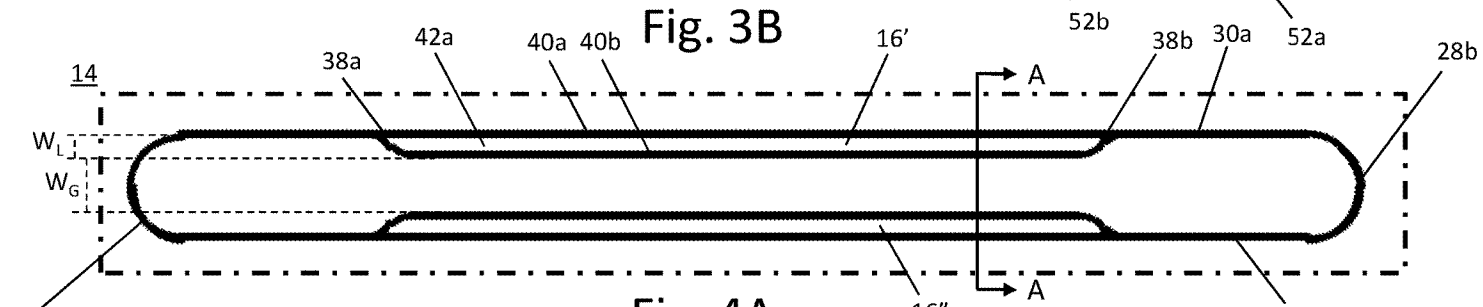
Fig. 3B
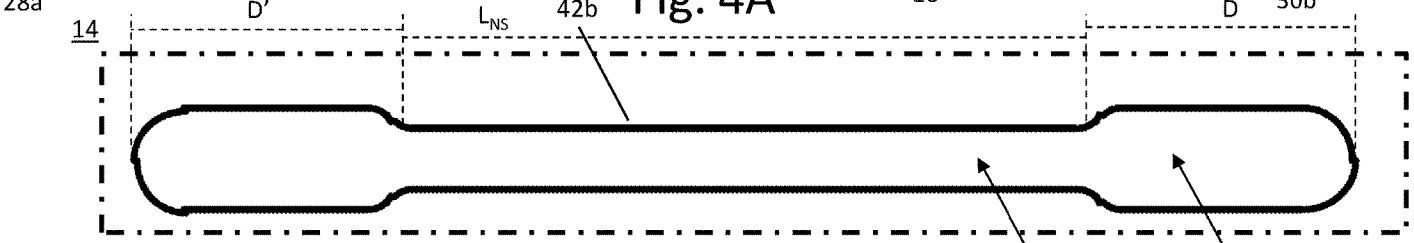
Fig. 4A
Fig. 4B

TABLE WITH SLOTS AND LEDGES

CROSS-REFERENCE TO RELATED APPLICATIONS

This application claims priority to U.S. Provisional Patent Application No. 63/108,839 filed on Nov. 2, 2020 which is incorporated by reference herein.

STATEMENT REGARDING FEDERALLY SPONSORED RESEARCH

Not Applicable.

APPENDIX

Not Applicable.

BACKGROUND OF THE INVENTION

Field of the Invention

The present invention relates to a table for securely holding and routing accessories such as cables and for working, more particularly to a table with an organization system that facilitates routing cords, cables, wires and the like.

Related Art

Side tables, desks and various other types of tabletops in the prior art have holes within the tabletop through which cables can be passed and plugged into power sources or other ports, such as wired communication ports, below the table or desk or in a wall outlet adjacent to the table or desk. These currently known tables with cable management functionality generally disclose one or more holes located at particular positions on the table's top surface that can be covered when they are not being used. Typically, these holes are arranged towards the back corners of desks, edge of side tables or towards the center of large conference tables to avoid interrupting the main working surface of the tabletop. There may also be a hole in a back panel of the desk or table which allows one or more cords or cables to pass from the wall outlet through the hole and into the space below the desktop or tabletop from the backside. However, most of these holes do not act as a support or anchoring structure for tech accessories like phones and tablets and instead only provide limited routing means for wires and cords associated with the accessories.

When in use, wires pass through the holes and are generally run into a cable collection area or are further routed in "wire channels" to a power source or other electronic port. In many cases, wire channels route wires down the legs of the desk or table. Some desks do not route cables to external power sources or similar electronic ports but instead provide a "technology trough" below the tabletop' s working surface to provide readily accessible power without the need for long and/or exposed wiring. However, the tables that provide more direct access to power sources or other electronic ports typically suggest a permanent attachment of the electronic port within the technology trough. Since the ports are permanently attached, a user cannot quickly attach their power source or charger to these technology troughs and then remove it sometime later. Alternatively, in prior art tables that have routing holes in the top surface but which do not have any cable collection system, a cord that is fed through the hole tends to hang down beneath the tabletop and may cause disruptions by rubbing against the leg of the user of the table, or in the worst-case scenario, a user may kick against it by accident, thus dislodging it from a power source.

Another problem with desks and tabletops in the prior art that include holes for cord management is that most of the holes in tables and desks are large and aesthetically unappealing. When grommets or covers are used to provide a more atheistically pleasing look, the covers project above the top surface of the tabletop and can interfere with the use of the tabletop by reducing the flat working area on the top surface the tabletop. In addition, the covers and grommets provide limited functionality wherein they close the hole when it is not in use. Thus, there is an additional desire to those having skill in the art to provide a multifunctional cable management system which not only provides adequate cable management that can also hold and support accessories but also has multifunctional covers which can be used for more than simple covering a hole in the tabletop when it is not in use.

Examples of desk and tables in the prior art which have attempted to provide improved cable management system include U.S. Pat. No. 10,492,601 as well as the iSkelter SlatePro Tech Desk and the Artifox 01 desk. Although effective at managing cords for electronics on the top of the table, each of these prior art designs have a permanent opening in the top surface and the overall work surface is thereby reduced. Furthermore, accessories can only be supported within the provided grooves and no additional supporting means is included.

Benches are the most common furniture accessory for gatherings or a quick place to sit down. Generally, benches happen to be a simple flat surface with no provision for storing or any other utility function. Also, it is quite common for people to carry items such as laptops or bags and other personal accessories with them. Benches do not provide any special location to safely store these items without compromising the available seating space causing users to leave these precious items on the surface of the bench. Further, some of the items may be fragile in nature, and if left unattended on the surface of the bench, there is a good possibility of accidents that can cause damage. Thus, it is an object of this invention to provide a bench that has sufficient safe storage spaces for decorative and useful items alike enhancing entryway, media consoles, residential seating, office environments, etc.

SUMMARY OF THE INVENTION

In one aspect of the invention, a table has a tabletop with a slot having a ledge that can support a tab to create a planar tabletop working surface devoid of any openings while also providing a pass through for cords and a supporting slot for accessories when the tab is removed. Thus, it is one object of this invention to provide a table that can route cords, cables and wires in a discreet manner, and when not in use, be sealed such that the surface does not reveal any unevenness or bumps that can make its appearance unappealing. It is a further object of the invention to provide a neat way of organizing the cords and wires beneath the table surface in such a manner that it does not pose any threat, obstruction or inconvenience to the user.

In another aspect of the invention, the tabs that are used to plug the slots can be arranged next to one another and set on the top surface of the tabletop to hold additional accessories such as cards and papers. Accordingly, it is another object of this invention to include multifunctional features that allow users to customize their work space as they see fit and use the provided elements in a customizable fashion.

In a general aspect of the invention, the inventive aspects for the table can be applied to any type of furniture that has a tabletop, including desks, conference tables, side tables, end tables, night stands, and wall shelves.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIGS. 3A and 4A show top detail views of various slot and ledge embodiments according to the invention described herein.

FIGS. 3B and 4B show bottom detail views of various slot and ledge embodiments according to the invention described herein.

DETAILED DESCRIPTION OF THE PREFERRED EMBODIMENTS

The following description of the preferred embodiment(s) is merely exemplary in nature and is in no way intended to limit the invention, its application, or uses.

Figures 1A, 1B, 1C:
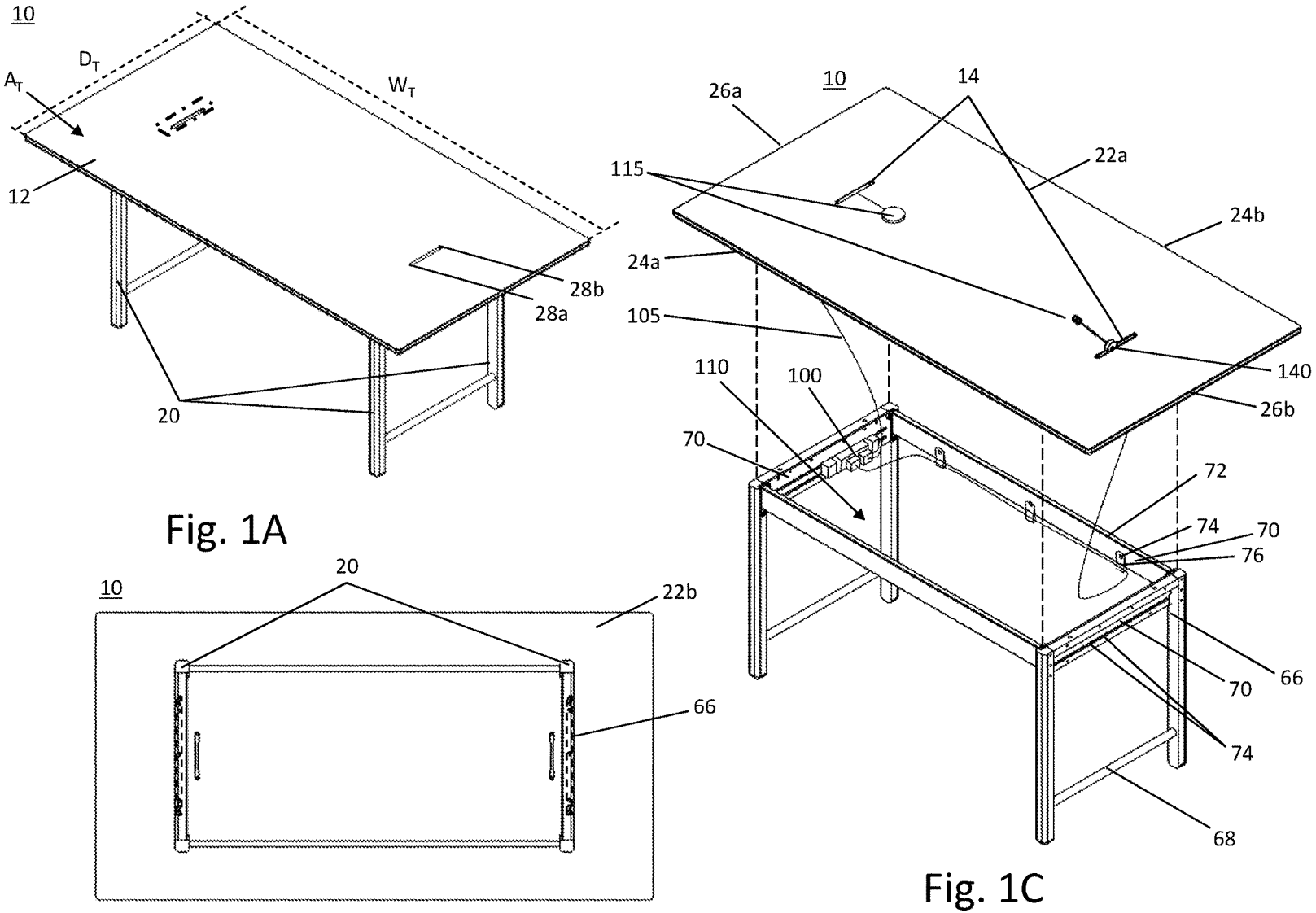
FIGS. 1A, 1B and 1C respectively depict a perspective view, a bottom view and a partially exploded perspective view of the table according to the invention described herein.
Figure 2B:
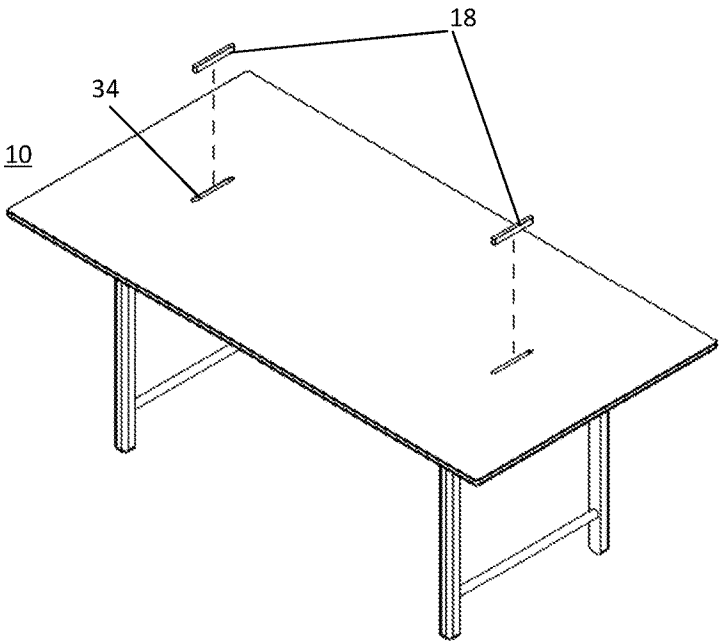
FIGS. 2A and 2B show the table and tab according to the invention described herein.
Figure 2A:
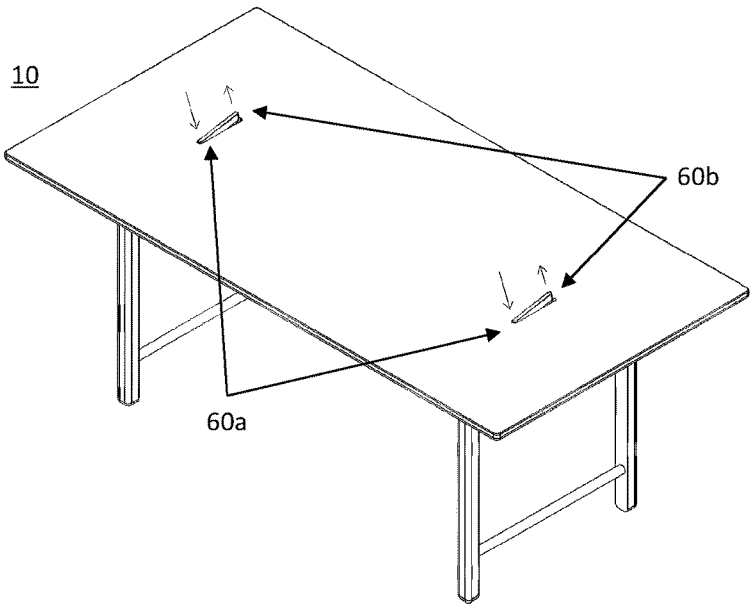
Figure 2C:
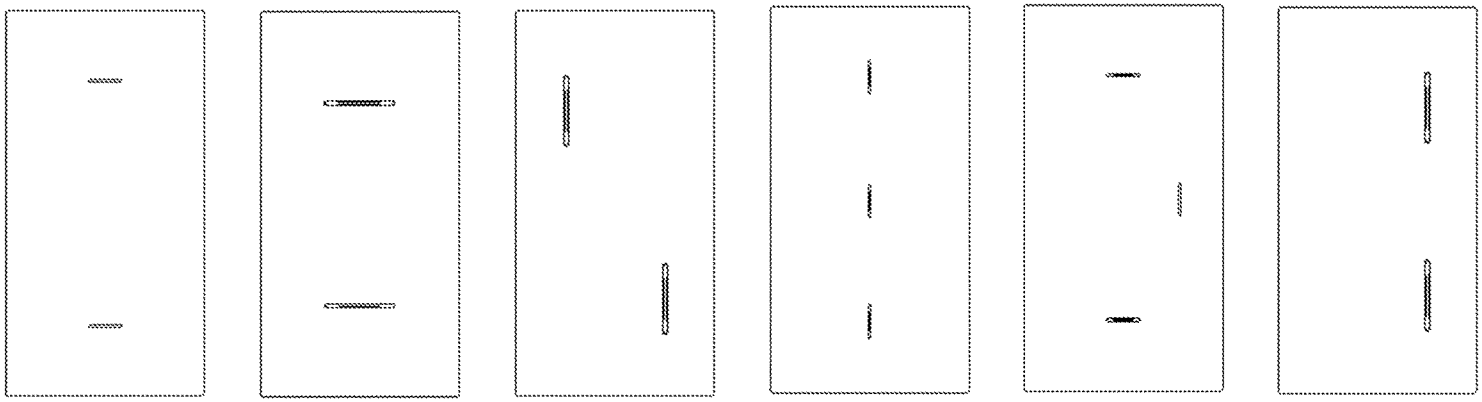
FIG. 2C shows alternative slot sizes and configurations in the table.

As generally shown in FIGS. 1 and 2, the invention described herein is a table 10 for holding and storing accessories 100 such as electronic devices and other equipment having a slot in the top surface of the tabletop that extends through the bottom surface of the tabletop. The slot allows power cords, communication wires, and other cables to extend through the tabletop from the top of the table to electronic power devices and communication hubs beneath the tabletop. A ledge is provided within the slot proximate to the bottom surface of the tabletop to not only allow items to be supported within the slot that may be smaller than the width of the slot, such as a tablet or smart phone, but also to allow a tab to plug the slot when it is not in use so that the top of the tab is flush with the topside of the tabletop and thereby create a flat tabletop surface across the entire tabletop surface area, devoid of any depressions, recesses, apertures, grooves or the like. Subsequently, the tab can be removed from the slot to route cables from the top surface of the tabletop and/or to allow the accessory to be supported therein. Furthermore, the tab can also be used to support other accessories on top the tabletop when removed from the slot as further explained herein.

The tabletop 12 has a top surface 22*a* and a bottom surface 22*b* with a front edge 24*a*, back edge 24*b*, and a pair of side edges 26*a* and 26*b* which define the tabletop's area ($A_T$) that is supported by a plurality of legs attached to the bottom surface of the tabletop. The distance between the front edge and back edge defines the depth of the tabletop ($D_T$), the distance between the pair of side edges defines the width of the tabletop ($W_T$) and the distance between the top surface and the bottom surface defines the thickness ($T_T$) of the tabletop. The table is generally rectangularly shaped, wherein the edges between two sides of the rectangle may be along a line or may be curved. However, the shape of the table is not intended to be limiting and non-rectangular tabletops not only may be used but also are encompassed within the scope of the invention described herein.

One or more slots 14 may be positioned at any location on the tabletop but it is preferred that two (2) slots are located on opposite sides of the tabletop, preferably proximate to and spaced slightly inward of crossbeams connecting the opposing legs as shown in FIGS. 1 and 2. The slot extends vertically through the tabletop's full thickness while the ledge preferably projects horizontally partway into the slot's open space adjacent to the tabletop's bottom surface. Accordingly, cords and cables 105 can be routed from the space 110 below the tabletop up through the slot to electronic devices 115 that are positioned on the tabletop. Additionally, electronic devices, such as tablet computers and smart-phones, and other accessories, such as lights and stands, can be held by the ledge in the slots with their cables routed beneath the tabletop. Further, the tabs corresponding to each slot can be used together to create an additional supporting structure while cables are routed through the slot as further explained herein.

Regardless of the number and location of the slots within the tabletop, each slot longitudinally extends a slot length ($L_S$) between a front end 28*a* and a back end 28*b* and has an inner side 30*a* and an outer side 30*b* that are spaced from each other by a slot width ($W_S$). The slot is elongated so that the slot length is preferably more than five (5) times as long as the slot width ($L_S>5*W_S$). Each slot also has an upper edge 32*a* within the top surface of the tabletop and a lower edge 32*b* that is preferably adjacent to the bottom surface of the tabletop; that the upper edge and lower edge are spaced from each other by a slot depth ($D_S$) and are connected by a peripheral sidewall 34. As particularly shown in FIG. 6, the sidewalls bound an open space 36 within the slot wherein and include a pair of planar walls 34*a* and 34*b* which are parallel to one another such that the slot vertically extends through the tabletop. Further, the parallel planar walls are without any deviations between the opposing ends.

To support the tab described herein when engaged with the slot and accessories when the tab is removed, at least one ledge 16 is provided within the slot, preferably at the lower edge of the slot with the ledge being recessed a recessed depth ($D_R$) from the top edge of the slot. The ledge has a ledge front end 38*a* and a ledge back end 38*b* that are respectively situated proximate to the front end and back end of the slot along with a proximal edge 40*a* connected to the tabletop along one of the sides of the slot and a distal edge 40*b* that projects a ledge width ($W_L$) into the slot space from the proximal side. The distal edge is also spaced a gap width ($W_G$) from the opposing side of the slot in embodiments with a single ledge or the distal edge of the opposing ledge in embodiments having two ledges. When two ledges are provided as depicted in FIG. 4, it will be appreciated that each ledge has a front and back end, a proximal edge and a distal edge with one ledge 16' extending from one side of the slot while the opposite ledge 16" extends from the other side of the slot and the gap with is provided therebetween. Preferably, each ledge projects into the slot space by a distance that is less than one-third the width of the slot between the peripheral sidewalls ($W_L<1/3*W_S$).

Although the opposing ends of the ledge are respectively proximate to the opposing ends of the slot, one of the ends of the ledge is spaced a distance (D) from the end of the slot such that spaced distance between the ends of ledges and the ends of the slot is devoid of the ledges and create a widened section 52*a* with a narrow section 52*b* between the distal edge of the ledge and the opposing side of the slot or opposing ledge. In particular, FIGS. 3A and 3B show slot and ledge embodiments with a widened section on one end of the slot and a narrow section extending a narrow section length ($L_{NS}$) from the widened section to the opposite end of the slot.

In the preferred embodiment shown in FIGS. 4A and 4B, these slots are dumbbell shaped such that a narrow section is provided in the middle of the slot between a pair of widened sections on opposite ends. In this embodiment, the second end of the ledge is spaced a second distance (D') from the second end of the slot with another widened section being formed between the second end of the slot and the second end of the ledge. Accordingly, the narrow section extends the length ($L_{NS}$) between the widened sections. Regardless of whether one or two widened sections are provided, the section length is greater than the distance between the ends of the ledge and the ends of the slot so that the tab or accessory supported in the slot does not unwantedly fall through the slot. Because the gap width along the narrow section is narrower than the width of the slot along the widened section, cords, cables and wires can be inserted into the narrow portion while wider objects such as cord heads may fit through the wider portion of the slot.

Figure 6A:
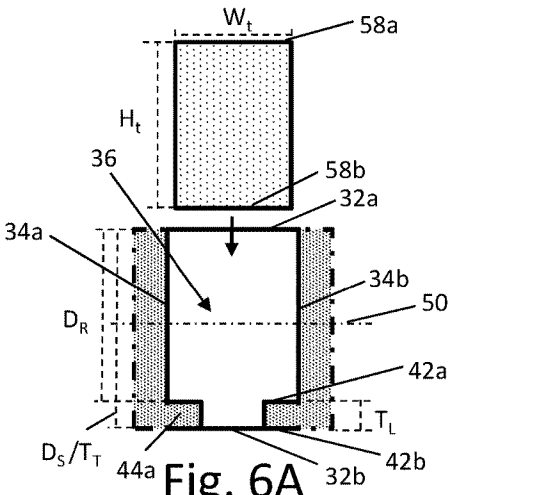
FIGS. 6A, 6B, and 6C depict detail cross-sectional views of the slot and ledge according to the invention described herein.

FIG. 6A shows the slot and ledge with a cross-sectional view that is taken through the tabletop along the section A-A in FIG. 4A. In this embodiment, the ledge is integrally formed with the tabletop, extending inwardly from the peripheral sidewall into the slot, preferably with the bottom of the ledge 42*b* aligned with the bottom edge of the slot and the top of the ledge 42*a* situated below the midpoint of the sidewall 50. The ledge's thickness ($T_L$) is preferably thinner than one quarter the slot depth ($T_L<1/4*D_S$) to provide sufficient recessed depth for holding accessories while providing sufficient structural support for tabs and/or the accessories that are held within the slots.

Furthermore, it will be appreciated that when the ledge is integrated 44a with the table in the slot, the recessed depth is less than the slot depth and table thickness.

Figure 6B:
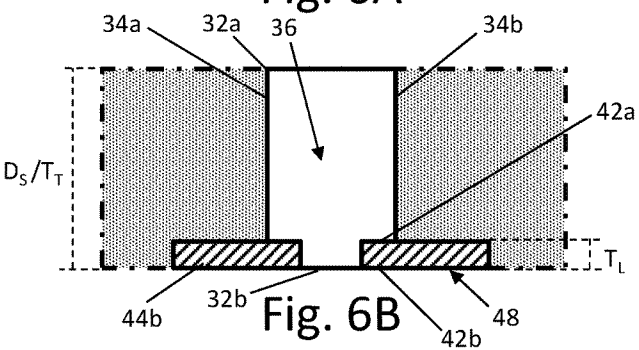
Figure 6C:
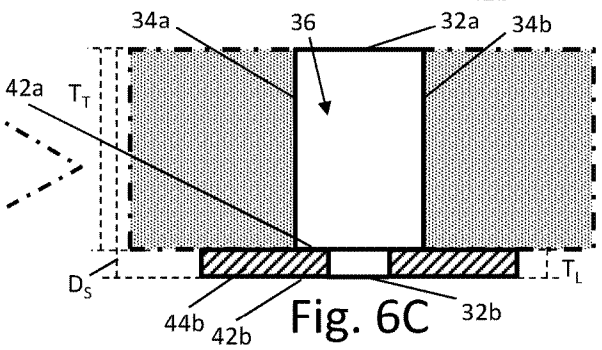
Figure 5A:
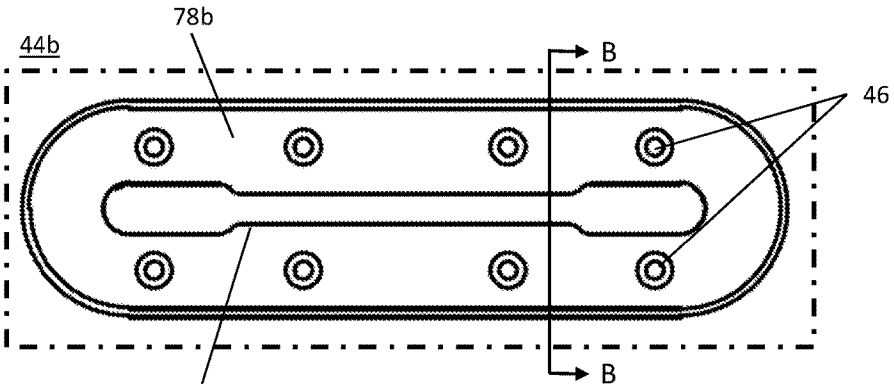
FIGS. 5A and 5B respectively depict a bottom view and a perspective view of an alternative ledge embodiment according to the invention described herein.
Figure 5B:
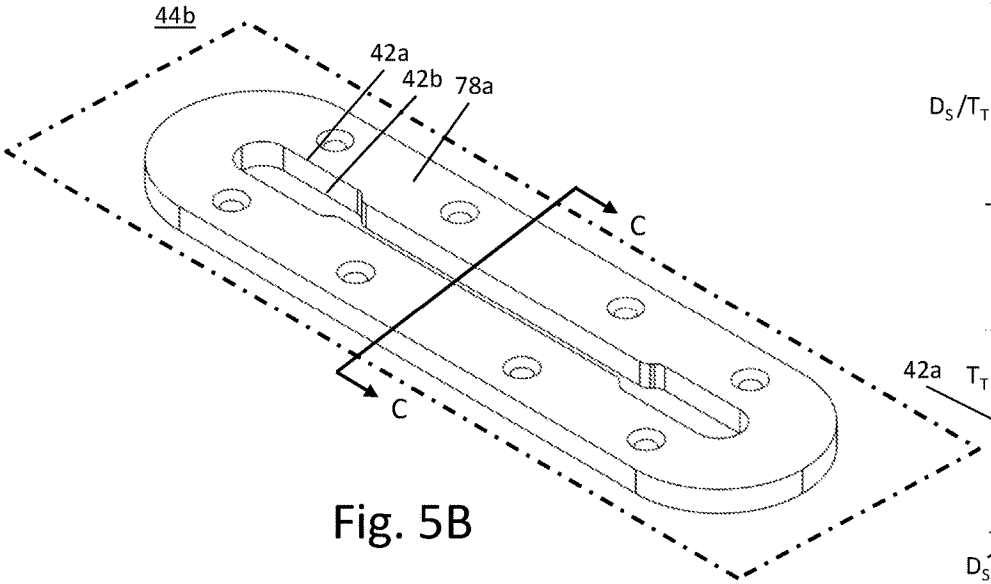

In other embodiments, such as particularly shown in FIGS. 5A and 5B, the ledge may be comprised of a ledge bracket 44*b* that is mounted to the bottom surface of the tabletop beneath the slot with fasteners 46. FIGS. 6B and 6C show cross-sectional views of the tabletop and ledge bracket taken along the sections B-B and C-C in FIGS. 5A and 5B, respectively. In the embodiment shown in FIGS. 5A and 6B, the bottom side of the tabletop has a recessed area 48 around the slot, and the ledge bracket fits in the recessed area so that the outwardly facing side 78*b* of the ledge bracket is substantially adjacent to and flush with the bottom surface of the tabletop. Accordingly, in this embodiment, the recessed depth is less than the slot depth and table thickness just as in the slot with the integrated ledge. In the embodiment shown in FIGS. 5B and 6C, there is no recess in the tabletop's bottom side so the ledge bracket protrudes slightly below the tabletop's bottom surface and forms the lower edge of the slot beneath the tabletop's bottom surface. Accordingly, in this embodiment, the slot depth is greater than the thickness of the table by the thickness of the ledge bracket, and the inwardly facing side 78*a* of the ledge bracket is adjacent to the tabletop's bottom surface.

To provide a planar worksurface across the entire area of the tabletop when the slots are not in use, the table also includes tabs 18 that are received in the slots in an engaged position and which are removed from the slot in a disengaged position. Each tab includes a tab length ($L_t$) between a pair of tab ends 54*a* and 54*b*, a tab width ($W_t$) between a pair of tab sides 56*a* and 56*b* and a tab height ($H_t$) between the top surface 58*a* and the bottom surface 58*b* of the tab. Tabs may be made of a suitable material, such as acrylic, wood, metal, felt, plastic, masonry, composite laminates, and any other material that has properties suitable for the application, and is also conducive for mass production.

Preferably, the tab has a flush top surface 58*a* that is flush with the top surface of the tabletop when in the engaged position and the sides of the tab are flush with the sides of the slot to create a planar work surface across the entire area of the tabletop as well as provide an aesthetically pleasing appearance with minimal seams. Accordingly, the tab width and length are respectively less than the slot width and length such that the tab can be received in the slot but the dimensions are sized so that the tab is snuggly fit within the slot. Furthermore, the tab height is approximately equal to the recessed depth between the ledge and the top edge of the slot such that the bottom surface of the tab rests against the ledge and the top surface of the tab is flush with the top edge of the slot and the top surface of the tabletop in the engaged position.

To facilitate removal of the tabs from the slot when the top surface is flush with the top surface of the tabletop and no gripping surface is provided, the spaced distance between the ends of the ledge and the slot create a widened section to allow the tab to be removed by pushing on one end of the tab that depresses into the widened section while the opposite end pops up from the slot and can then be picked up using fingers or other tools if necessary. As illustrated in FIG. 2A, one end of the tab rotates downward 60*a* into the widened section of the slot while the other end rotates upward 60*b* and out of the slot so that a person can easily move the tab from the engaged position to the disengaged position. Alternatively, the tabs could be removed by pushing them upward from the bottom of the table through the bottom edge of the slot.

Figure 8:
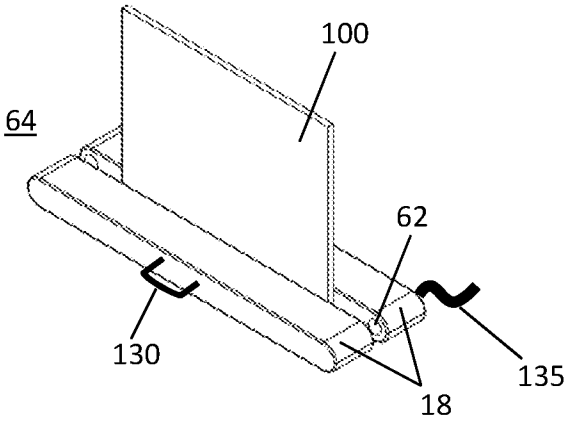
FIG. 8 shows a detail view of a pair of tabs in an alternative configuration according to the invention described herein.
Figure 7A:
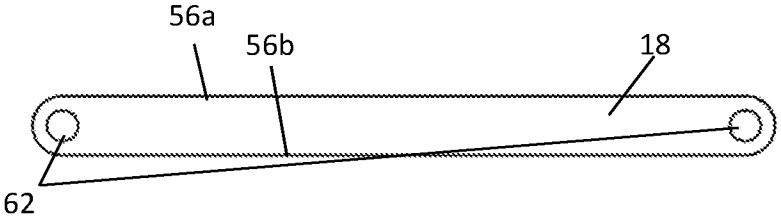
FIGS. 7A and 7B respectively show a bottom view and a side view of the tab according to the invention described herein.
Figure 7B:
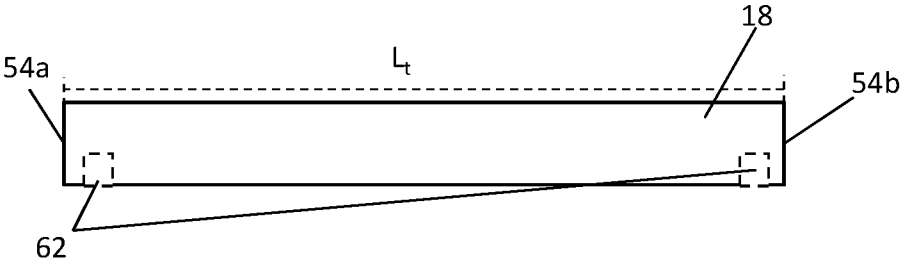

As particularly shown in FIGS. 7A and 7B, the tabs preferably include magnets 62 embedded within or mounted to the opposite ends of the tabs. Once removed from the slots in the table, the tabs are designed in such a way that they can be releasably connected to one another by the magnets provided within one of the sides or ends and thereby create another supporting structure 64, as shown in FIG. 8. In particular, the opposing magnetic sections of each tab can abut and magnetically connect to one another and another accessory can be supported on the top surface of the tabletop. To facilitate the magnetic connection, it will be understood that the magnets are arranged at respective positions on the tabs so that the magnets have opposite polarity, wherein one magnet's north pole faces outwards while the other magnet's south pole faces outwards and thereby allowing a pair of tabs to magnetically connect. The opposite polarity allows the tabs from opposite ends of the table to be positioned next to each other so that opposing poles are adjacent to one another and are magnetically attracted so that they can hold a card, photo, ruler, or other flat object. Accordingly, the tabs not only plug the slots and create a flat worksurface across the entire surface of the tabletop when engaged, they also provide additional functionality when not engaged.

Figure 9:
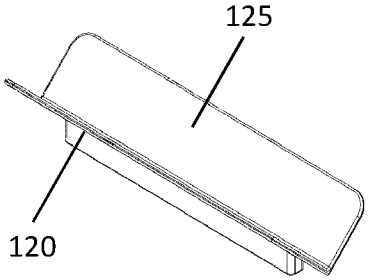
FIG. 9 depicts an accessory tray having a tab portion according to the invention described herein.

Alternative tab embodiments not shown in the drawings may include troughs in the bottom or side surfaces such that the tab can be flipped upside down and inserted into the slot with the trough being used as a stand or for holding suitable accessories, such as writing utensils, erasers, stationeries, and the like. Further still, when the tabs are removed from the slots, the slots could also receive other structures having a tab portion 120 that is received in the same manner as the tabs used to plug the slots as described above, such as monitor stands, lights, writing utensil holders or trays 125 as shown in FIG. 9. It will be appreciated that, similar to a tray that projects upwards from the slot above the tabletop, the tab may have a small handle 130, a leather strap 135, or some other handhold that projects from the tab's top surface, allowing a person to pull the tab out from the slot without pushing one side down to pop up the other side. Since the tray 125 extends past both ends of the slot, it would not be possible to push down one side and pop up the other side of the tab portion that extends into the slot. In comparison, a handhold 130, 135 could allow at least one end of the tab to be depressed into the end of the slot which does not have any ledge so the other end of the tab is elevated out of the slot so the tab could be pulled out with the handhold or popped up.

As noted herein, the table comprises a plurality of legs 20 on which the tabletop sits, typically placed on the four corners of the rectangle, extending from at least the bottom surface to the ground. In the preferred embodiment the legs are connected to the bottom surface of the table with at least one metal bracket 66. However, other fastening means of attaching the plurality of legs to the bottom surface of the table are known in the art and could be used to connect the legs to the tabletop without departing from the invention described herein. Furthermore, a pair of the plurality of legs may be connected to each other through at least one support 68 located towards the bottom portion of the leg and/or may be connected to one another at the top through a frame support.

FIG. 1C particularly shows the legs along with supports under the bottom surface spanning the distance between the front and back edges of the rectangular table along with opposing cable grids 70 spanning the length of the side edges of the table between front and back legs as well as the length of the back edge of the table between the back legs. The cable grid along the back of the table comprises at least one groove 72 and/or an array of apertures 74 that can hold cords, cables, wires and the like on either the front face or back face of the grid with fasteners. Although not intended to be limiting, in one embodiment, the fasteners may be magnets that are mounted within the apertures and magnetically hold loop straps 76 with at least one magnetic end, such as depicted along the back cable grid in FIG. 1C. The fasteners enable clipping of cords and other accessories onto the grid, such as providing guidance for accessory cords along a certain direction of the grid to a power strip present at a particular location. In other embodiments, the fasteners used may include hook and loop straps, wire, string, clamps, screws, bungee cords, tape, hooks, or similar attachment means. In a further embodiment, a felt knot 140 or other anchor is provided to secure the cords and cables in a particular place to be easily accessible from top surface and to prevent the wires from falling through the slot when they are disconnected from the electronic devices.

As described herein, the number and location of the slots in the tabletop is not intended to be limiting but it will be appreciated that the preferred embodiment includes two (2) slots on opposite ends of the tabletop. Furthermore, as shown in FIG. 1B, it is also preferred that the slots are positions proximate to the mounting brackets of the legs such that a cable grid supported by the legs is situated proximate to the slots and the accessories held therein.

Further still, it will be appreciated that the cable grid could be positioned at any location beneath the tabletop and is not limited to spanning the depth of the tabletop top between the front and back edges. Although it is preferred that the grid is provided at a location that is proximate to the slots in the tabletop so that cords do not have to be routed a great distance, persons having an ordinary skill in the art will appreciate that the grid could be positioned at a number of locations including along the entirety or a portion of the back and rear edge or within the middle portion of the table, such as for a larger conference table. In addition, it will also be appreciated that in alternative table designs the grid could be attached directly to the underside of the tabletop rather than to legs which support the tabletop that may not necessarily be required. For example, a wall mounted counter may not include any legs but the slot, tap and cable grid described herein could be used with the wall mounted tabletop without departing from the inventive aspects of the invention described.

As will be understood by those in the art, the invention as described herein can also be used to make a working desk that will provide the requisite advantages of routing the cables and the cords appropriately through the slots. In another embodiment, a conference desk is provided herein based on the suitable location of the slots towards the center of the longitudinal axis of the rectangle. Other such variations will become apparent to one of ordinary skill in the art, and is envisioned to be encompassed within the scope of the invention.

Figure 10B:
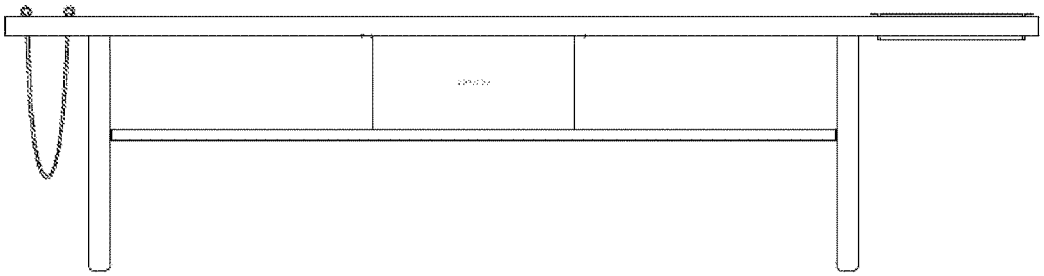
FIGS. 10A and 10B depict a bench invention in a perspective view and front view, respectively.
Figure 10A:
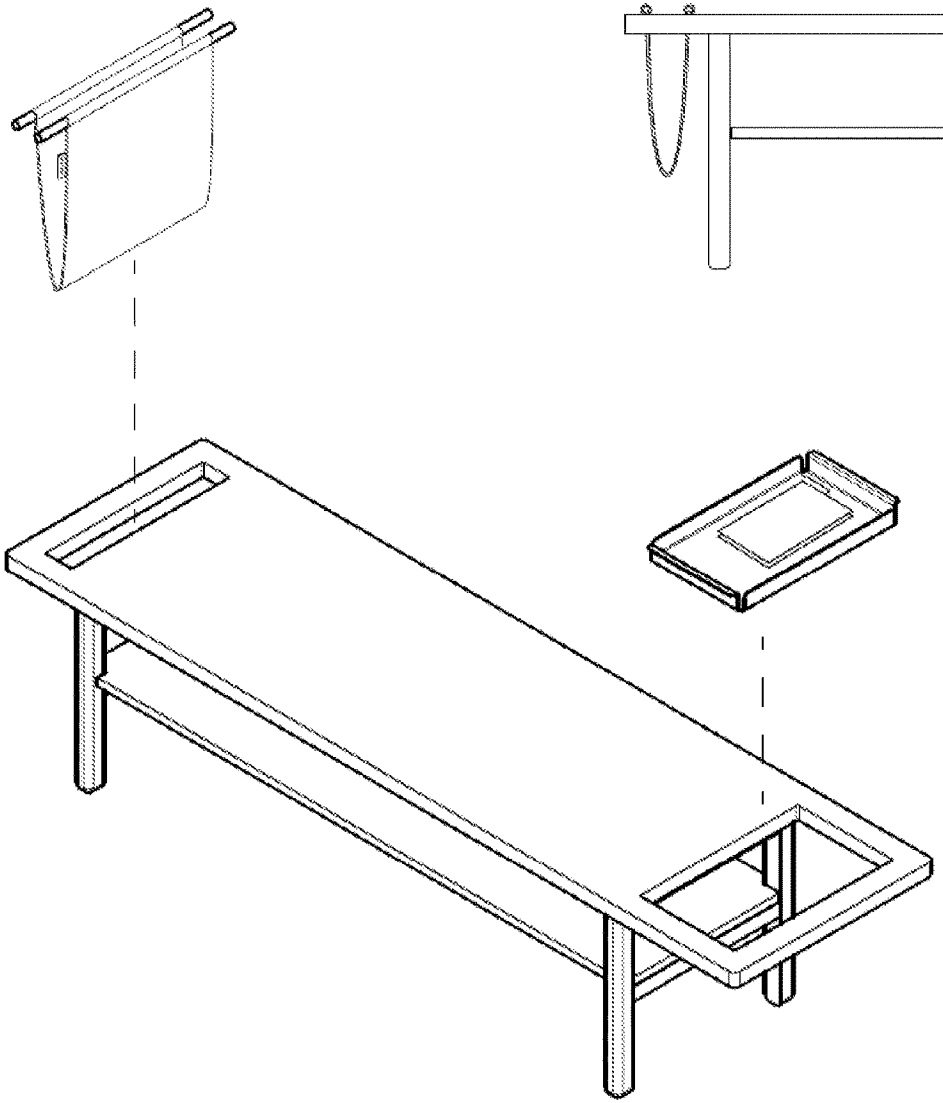

In another aspect, the invention provides a two-tiered bench or coffee table that has an upper panel and a lower shelf. In a typical exemplary embodiment, the upper panel and lower shelf are rectangular in shape having a ninety degree (90°) angle between the sides. FIGS. 10A and 10B are illustrations of the bench version of the invention in a perspective view and in a front view, respectively. However, one of ordinary skill in the art can extend the ideas expressed in the invention to other shapes and edges, all of which are envisioned to be encompassed within the scope of the invention. The upper panel is generally longer than the lower shelf, while upper panel and lower shelf may have the same width, or the lower shelf may be narrower than the upper panel.

The bench also comprises legs connected to and extending from a bottom surface of the upper panel. An intermediate portion of the legs between the top end and bottom end are connected to the lower shelf, preferably at the corners of the lower shelf. Accordingly, the length and width of the lower shelf are preferably defined by the position of the legs relative to the upper panel.

The upper panel comprises two or more slots, typically of varying sizes and shapes configured to receive different types of receptacles with an upper panel comprising a larger slot and a narrower slot. The larger and the narrower slot is configured to receive a flexible scroll. The scroll may be made of fabric that is held by a pair of dowels that rest on the top surface of the upper panel. Alternately, the dowels may be locked in place on the side of the slot through suitable means. Other such means of holding the scroll will become obvious to one of ordinary skill in the art, and is envisioned to be encompassed within the scope of the invention.

The broader slot can hold a scroll as described herein or a tray. Similarly, the narrower slot can hold a scroll or a tray. The tray is made of a rigid material such as a metal, cording, acrylic or hard plastic and has flanges that extend from opposite sides at the top of the tray which extend over the sides of the slot to hold the tray within the slot. Power strips, routers, chargers, etc. can be held and stored behind the wood structural support between the two horizontal surfaces and run cords neatly to the tray and scroll. The tray is configured to have openings on the corners which allow the cords from chargers and cables to pass through the tray on which they are held to the lower shelf below the top of the bench. In this manner, the bench can be used to power electronic devices in a seamless manner. Further, when a tray is placed on the slot, it can be used to hold plants, books, blankets, shoes, clothing articles, or any other accessory. The scroll can be used as a soft place to store books, laptops, bags, etc. and which may be partially concealed in the scroll, while the tray can be used as a display area. In a preferred embodiment, the scroll and the tray are provided such that they can be interchangeably used in both slots in a facile manner. Suitable manner of providing the scroll and the tray that render them usable in both slots are known in the art.

In some embodiments, the upper panel extends beyond the perimeter of the lower shelf while in other embodiments, the upper panel and lower shelf are aligned with each other. Similarly, in some embodiments, the slots are cut through the upper tier beyond the perimeter of the lower tier while in other embodiments the slots are cut through the top tier within the perimeter of the lower tier. Slots can be equal in size and length or may be different on either side. Slots can also be on the upper panel as well as the lower shelf. The invention is designed to work with drop in accessories. The scroll and tray are meant to mix and match within the slots. The scroll is flexible and can be used in either size slot, while the tray is rigid and can be formed in various sizes and depths according to slot sizes. It will be appreciated that a tray could be flat with flanges on opposite sides so that the topside of the tray between the flanges is flush with the upper surface around the slot. These configurations work well as a bench, seating, entryway storage, media console, coffee table, or other stands. The upper panel of the embodiments described can also include the slots with tabs. It will also be appreciated that the table and the bench also both have support structures that extend between the legs below the topside surface; for the table with the longer legs, there is a frame at the upper end of the legs immediately below and in contact with the tabletop with a pair of braces towards the lower end of the legs, and for the bench with the shorter legs, there is a lower shelf spaced a distance below the upper surface which connects all of the legs. The faces of the framework elements with the largest surface areas are substantially perpendicular to the plane of the tabletop while the lower shelf is situated in a plane that is substantially parallel to the plane of the upper surface.

The bench of the invention may further comprise at least one support piece that extends from the bottom surface of the upper panel to the top surface of the lower shelf. A center support piece that bolsters the upper panel against the lower shelf may also be provided. This is provided to enhance support for the upper panel as typically it is load bearing. The upper panel of the bench is generally used for seating one or more persons, and hence requires the extra load bearing supports, which is provided as described herein. The support pieces are provided suitably off center on the longitudinal axis of the upper panel and centrally located on the transverse axis. It will be appreciated that additional supports could be fixed between the upper panel and the lower shelf. For example, two support pieces may be symmetrically positioned on either side of the center of the longitudinal axis to enhance the load bearing capacity of the upper panel. The support pieces can also be used to route cables, cords, power strips and the like such that they can be hidden from view.

Slots are intended to be used for various accessories to be dropped in and display or store items within some of the invention embodiments. Each slot also has the ability to route cables through the upper surface allowing neat cable management below. In the table, cables are held on the grid, able to run across the long edges through magnetic or clip placement and run up through the slots for device charging. In the bench, power strips and chargers are concealed behind the support and run up through the slots into scroll and tray. Both the scroll and the tray have openings at the edges for seamless cord pass thru. An inlay tray can be placed on the top surface of the upper panel, wherein the inlay further provides extra properties.

The table and the bench of the invention as described herein may be provided in an easy to assemble and disassemble form that will enable it to be transported to a suitable location, and also for setting up and storing. This can be achieved in many different ways, such as but not limited to, suitable foldable lines at appropriate locations of the tiers, each piece being removably attached to each other, and combinations thereof. Durable joints allow for multiple cycles of assembly, disassembly, and reassembly throughout the lifetime of the product. Both table and bench embodiments show examples of these joints, such as the ends of the table supports mounted to the underside of the table top and to the underside of the bench's upper surface and lower shelf with similar inlays, and attaching the middle support between the upper panel and the lower shelf.

The invention for the table allows a user to particularly design their work space to meet their needs and thereby increase productivity. Although the above description relates primarily to a desk or a conference table, the present invention may be applied to a night stand, an end table, or a dining table. In another embodiment, a single desk variation may be combined together with other desks to create a larger work station, work bench, or a bench-style conference table where multiple tables are pushed together to make one larger work surface. Accordingly, although the slots are shown as longitudinally extending between the front and the back of the tabletop, it will be appreciated that one or more slots could longitudinally extend between the sides of the tabletop and may be positioned towards the center of the desk between the front and crossbeams, slightly forward or rearward of the back crossbeam, or towards the back edge of the desk.

It should be appreciated that the present invention can be made with any number of materials including but not limited to hardwood, veneer, aluminum, steel, stone, solid surface, MDF, powder coated MDF, fiberglass, plastic, glass, concrete, or any other similar building material. Further, these materials may be combined in any fashion to arrive at the present invention.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Additional known structural elements, features, and accessories can be incorporated into the present invention, such as those described in U.S. Pat. Nos. 9,095,209 and 10,492,601 which are hereby incorporated by reference herein, and the inventive features of the present invention may also be incorporated into other items of furniture, such as shelves, workstations, and/or stands as particularly described in the '601 Patent. Thus, the breadth and scope of the present invention should not be limited by any of the above-described exemplary embodiments, but should be defined only in accordance with the following claims appended hereto and their equivalents.

What is claimed is:

1. A table for securely holding accessories and for working, comprises:

a tabletop comprising a top surface and a bottom surface, a front edge, a back edge, a pair of side edges, a thickness between the top surface and the bottom surface and a width between the pair of side ends;

a slot vertically extending through the full thickness of the tabletop, longitudinally extending a slot length between a first end and a second end, and spanning a slot width between a first side and a second side, wherein the slot comprises an upper edge in the top surface of the table, a lower edge adjacent to the bottom surface of the tabletop, and a peripheral sidewall extending a slot depth between the upper edge and the lower edge, and wherein the peripheral sidewall bounds an open space within the slot and is comprised of a pair of planar walls in parallel relationship to each other between the first end and the second end; and a ledge within the slot proximate to the lower edge and spaced a recessed depth from the top edge of the slot, wherein the ledge extends between a ledge first end proximal to the first end of the slot and a ledge second end proximal to the second end of the slot, wherein the ledge projects a ledge width into the open space of the slot from a proximal edge situated along the first side of the slot to a distal edge spaced a gap width from the second side of the slot, wherein the ledge first end is spaced a distance from the first end of the slot and leaves the first end of the slot devoid of the ledge, and wherein the spaced distance is greater than the slot width and is less than one quarter the slot length.

2. The table of claim 1, wherein the ledge is integrally formed in the slot and further comprises a ledge bottom side aligned with the bottom edge of the slot and a ledge top side recessed from the top edge of the slot by the recessed depth, and wherein the recessed depth is less than the slot depth.

3. The table of claim 1, wherein the ledge is comprised of a ledge bracket mounted to the bottom surface of the tabletop, wherein the ledge bracket comprises a ledge bottom side forming the lower edge of the slot and a ledge top side recessed from the top edge of the slot by the recessed depth, and wherein at least one of the ledge bottom side and the ledge topside are flush with the bottom surface of the tabletop.

4. The table of claim 1 further comprising an opposite ledge within the slot opposite from the ledge, wherein the opposite ledge extends between a opposite ledge first end proximal to the first end of the slot and an opposite ledge second end proximal to the second end of the slot, wherein the opposite ledge projects an opposite ledge width into the open space of the slot from an opposite ledge proximal edge situated along the second side of the slot and an opposite ledge distal edge spaced the gap width from the distal edge of the ledge, wherein the opposite ledge first end is spaced a second distance from the first end of the slot and leaves the first end of the slot devoid of the ledge.

5. The table of claim 1, wherein the ledge width is less than one-third the slot width.

6. The table of claim 1, further comprising a tab releasably received within the slot in an engaged position and removed from the slot in a disengaged position, wherein the tab comprises a tab length between a pair of tab ends, a tab width between a pair of tab sides, and a tab height between a tab top surface and a tab bottom surface, wherein the tab width is less than the slot width and is greater than the gap width, wherein the tab length is less than the slot length and greater than the ledge length, wherein the tab height is approximately equal to the recessed depth, wherein one of the ends of the tab rotates downward into the spaced distance in the slot devoid of the ledge and the other end of the tab is rotated upward out of slot to move the tab from the engaged position to the disengaged position.

7. The table of claim 6, wherein the tab top surface is comprised of at least one of a flat surface and a handhold projecting from the tab top surface, wherein the flat top is flush with the top surface of the tabletop in the engaged position, and wherein the handhold is positioned above the top surface of the tabletop in the engaged position.

8. The table of claim 6, wherein the tab further comprises a magnetized portion in at least one of the tab sides, the pair of tab ends, the tab top surface and the tab bottom surface, and wherein the magnetized portion of the tab engages the magnetized portion of a second tab in a stand configuration when in the disengaged position.

9. The table of claim 1, wherein the ledge second end is spaced a third distance from the second end of the slot and leaves the second end of the slot devoid of the ledge, and wherein the third spaced distance is greater than the slot width and is less than one quarter the slot length.

10. The table of claim 1, further comprising a plurality of legs, a cable grid, and a fastener, wherein the legs are connected to the tabletop, wherein the cable grid is comprised of a front face, a back face, and an array of apertures, wherein the fastener extends through the array of apertures and removably secures a section of at least one of the accessories to at least one of the front face and the back face, and wherein the cable grid is attached to at least one pair of the plurality of legs beneath the bottom surface of the tabletop.

11. A table for securely holding accessories and for working, comprises:

a tabletop comprising a top surface and a bottom surface, a front edge, a back edge, a pair of side edge, a thickness between the top surface and the bottom surface and a width between the pair of side ends;

a slot vertically extending through the full thickness of the tabletop, longitudinally extending a slot length between a first end and a second end and spanning a slot width between a first side and a second side, wherein the slot comprises an upper edge in the top surface of the table, a lower edge adjacent to the bottom surface of the tabletop, and a peripheral sidewall extending a slot depth between the upper edge and the lower edge, and wherein the peripheral sidewall bounds an open space within the slot and is comprised of a pair of planar walls in parallel relationship to each other between the first end and the second end; and a pair of ledges in the slot proximate to the lower edge and spaced a recessed depth from the top edge of the slot, wherein the ledges each respectively comprise a first ledge end proximal to the first end of the slot and a second ledge end proximal to the second end of the slot, wherein each of the ledges project a ledge width into the open space from a proximal edge respectively connected to the first side of the slot and the second side of the slot to a distal edge spaced a gap length from the distal edge of the opposing ledge, wherein the first ledge ends are spaced a distance from the first end of the slot and leave the first end of the slot devoid of the ledges, and wherein the spaced distance is greater than the slot width and is less than one quarter the slot length.

12. The table of claim 11, wherein the ledge width is less than one-third the slot width.

13. The table of claim 11, wherein the ledge further comprises a ledge bottom side and a ledge top side recessed from the top edge of the slot by the recessed depth, and wherein at least one of the ledge bottom side and the ledge topside are flush with the bottom surface of the tabletop.

14. The table of claim 11, wherein the second ledge ends are spaced a second distance from the second end of the slot and leave the second end of the slot devoid of the ledges, and wherein the second spaced distance is greater than the slot width and is less than one quarter the slot length.

15. The table of claim 11, further comprising a pair of tabs respectively received within the slots in an engaged position and removed from the slots in a disengaged position, wherein each of the tabs comprises a tab length between a pair of tab ends, a tab width between a pair of tab sides, and a tab height between a tab top surface and a tab bottom surface, wherein the tab width is less than the slot width and is greater than the gap width, wherein the tab length is less than the slot length and greater than the ledge length, wherein the tab height is approximately equal to the recessed depth, wherein one of the ends of the tab rotates downward into the spaced distance in the slot devoid of the ledge and the other end of the tab is rotated upward out of slot to move the tab from the engaged position to the disengaged position.

16. The table of claim 15, wherein each of tabs further comprise a magnetized portion in at least one of the tab sides, the pair of tab ends, the tab top surface and the tab bottom surface, wherein the tabs are positioned in a stand configuration when the tabs are in the disengaged position, wherein the magnetized portions of each of the tabs are situated in proximate to one another in the stand configuration, and wherein at least one of the accessories is supported by the tabs in the stand configuration.

17. A table for securely holding accessories and for working, comprises:

a tabletop comprising a top surface and a bottom surface, a front edge, a black edge, a pair of side edges, a thickness between the top surface and the bottom surface and a width between the pair of side ends;

a plurality of mounting brackets connecting a plurality of legs to the bottom surface of the tabletop;

a slot vertically extending through the full thickness of the tabletop, longitudinally extending a slot length between a first end and a second end, and spanning a slot width between a first side and a second side, wherein the slot comprises an upper edge in the top surface of the table, a lower edge adjacent to the bottom surface of the tabletop situated proximate to at least one of the mounting brackets, and a peripheral sidewall extending a slot depth between the upper edge and the lower edge, and wherein the peripheral sidewall bounds an open space within the slot and is comprised of a pair of planar walls in parallel relationship to each other between the first end and the second end; and a ledge within the slot proximate to the lower edge and spaced a recessed depth from the top edge of the slot, wherein the ledge extends between a ledge first end proximal to the first end of the slot and a ledge second end proximal to the second end of the slot, wherein the ledge projects a ledge width into the open space of the slot from a proximal edge situated along the first side of the slot to a distal edge spaced a gap width from the second side of the slot, wherein the ledge width is less than one-third the slot width, wherein the ledge first end is spaced a distance from the first end of the slot and leaves the first end of the slot devoid of the ledge, and wherein the spaced distance is greater than the slot width and is less than one quarter the slot length.

18. The table of claim 17, further comprising a cable grid between a pair of legs from the plurality of legs and a fastener, wherein the cable grid is comprised of a front face, a back face, and an array of apertures, and wherein the fastener extends through the array of apertures and removably secures a section of at least one of the accessories to at least one of the front face and the back face.

19. The table of claim 17, further comprising a tab releasably received within the slot in an engaged position and removed from the slot in a disengaged position, wherein the tab comprises a tab length between a pair of tab ends, a tab width between a pair of tab sides, and a tab height between a tab top surface and a tab bottom surface, wherein the tab width is less than the slot width and is greater than the gap width, wherein the tab length is less than the slot length and greater than the ledge length, wherein the tab height is approximately equal to the recessed depth, wherein one of the ends of the tab rotates downward into the spaced distance in the slot devoid of the ledge and the other end of the tab is rotated upward out of slot to move the tab from the engaged position to the disengaged position.

20. The table of claim 17 further comprising an opposite ledge within the slot opposite from the ledge, wherein the opposite ledge extends between a opposite ledge first end proximal to the first end of the slot and an opposite ledge second end proximal to the second end of the slot, wherein the opposite ledge projects an opposite ledge width into the open space of the slot from an opposite ledge proximal edge situated along the second side of the slot and an opposite ledge distal edge spaced the gap width from the distal edge of the ledge, wherein the opposite ledge first end is spaced a second distance from the first end of the slot and leaves the first end of the slot devoid of the ledge.

* * * * *